United States Patent [19]

Jiumr

[11] Patent Number: 4,796,882

[45] Date of Patent: Jan. 10, 1989

[54] PHYSICAL TRAINING APPARATUS

[76] Inventor: Fanchan J. Jiumr, 520, Chung-San Road, Shin-Woo Shiang, Taoyuan Prefecture, Taiwan

[21] Appl. No.: 87,854

[22] Filed: Aug. 13, 1987

[51] Int. Cl.[4] ..... A63B 69/06; A63B 21/00

[52] U.S. Cl. ..... 272/72; 272/73

[58] Field of Search ..... 272/72, 73, 67, 68, 272/69, 93; 128/25 R

[56] References Cited

U.S. PATENT DOCUMENTS

| | | | |
|---|---|---|---|
| D. 211,478 | 6/1968 | Margolies | 272/73 |
| 3,770,267 | 11/1973 | McCarthy | 272/72 |
| 3,777,745 | 11/1973 | Simjian | 272/73 |
| 4,140,312 | 2/1979 | Buchmann | 272/73 |
| 4,650,181 | 3/1987 | Yang | 272/72 |

*Primary Examiner*—Richard J. Apley
*Assistant Examiner*—S. R. Crow
*Attorney, Agent, or Firm*—David H. Semmes

[57] ABSTRACT

Physical training devices, particularly a longitudinally extending frame, supporting at its front a pedal driving device and at its back a slidable handlebar exerciser. A back massaging frame is supported intermediate the handlebar exerciser and the pedal driving device. The pedal device is pivotally connected to a slidable support for the massaging frame and the handlebar exerciser, such that pedaling action imparts longitudinal movement of the exerciser's back over the massaging frame.

6 Claims, 5 Drawing Sheets

PHYSICAL TRAINING APPARATUS

BRIEF DESCRIPTION OF THE INVENTION

A physical training apparatus comprised of a slidable support bar and a stepped pedal driving device which is connected to the front end of the slidable support bar. An arched massager frame is supported above the middle part of the said slidable support bar in a spaced apart position. Two interconnected sliding mechanisms are positioned on the said slidable bar at the front and back of the arched massager. An elastomeric seat mat covers the arched massager. A two-hand use handlebar swinging exerciser is adjustably positioned on the rear sliding mechanism. Due to the synchronous sliding movement of the forward and rear sliding mechanisms on the said sliding bar, and the continuous movement of the forward sliding mechanism as induced by the pedal driving equipment, the exerciser while laying upon the elastomeric mat and using his feet to pedal the driving equipment, obtains not only exercise of his feet, but, also, an arched-line massage of his back from waist to neck. The double-direction or reciprocal sliding movement of the front and rear sliding mechanisms induce the said elastomeric mat to make a corresponding forward and rear displacement. At the same time, while the exerciser's body also moves reciprocally with the elastomeric mat, his hands, also, can act upon the handlebar swinging exerciser in order to obtain a better physical training effect. Accordingly, this invention enables the exerciser to reach a sufficient physical training as in rowing and swimming, while obtaining a back massage at the same time.

BACKGROUND OF THE INVENTION

It is known that sports can increase physical health, but most of those who live in today's society are seated all day long during their work and are not sufficiently engaged in sport. Therefore, many people thick they must go out for competitive sports, such as tennis, basketball, or for individual character sports, such as swimming, slow running and weight lifting in order to reach the aim of sufficient exercise.

Competitive sport is not suitable for everyone because it requires a partner or group. Although the individual character sports, such as slow running can reach the aim of sufficient exercise, its defect lies in that one must exercise in an outdoors which is easily influenced by the weather or environment. Most individual character sports share this defect.

Various indoor exercising devices are not influenced by weather or environment. So, such devices are welcomed day by day to exercisers. But normal, indoor exercising devices are designed only for one sport. For example, a running machine is used for imitation of running action by the exerciser to obtain leg training, while a rowing apparatus is suitable for arm training. There are few exercising devices which can be used for different sports, such that the practicality of using traditional exercising devices decreases day by day.

The present invention is a new type physical training apparatus which not only can offer a sufficient physical exercise effect, but also can enable the exerciser to obtain a massage while simultaneously engaged in rowing, pedaling and swimming action. Therefore, the invention provides a new and most practicable indoor exercising device. The following effects are provided in comparison with the traditional or similar physical training devices.

1. This invention provides the exerciser with a more comfortable massaging effect by means of positioning foot massagers within the two pedal parts, as the exerciser steps on the pedals to take a pedaling exercise.

2. This invention enables the exerciser to obtain a comfortable stretching action to his fingers, while he takes a rowing exercise on the handlebar swinging exerciser by means of attaching a movable elastic clothing article to the hand grips.

3. This invention further provides the exerciser with spinal cord articulation by means of using the arched massager, which is so formed with an arched profile, having a lower front-end and a higher rear-end in accordance with ergonomics principles.

BRIEF DESCRIPTION OF THE DRAWINGS

As shown in FIGS. 1 and 2, the training device comprises a slidable or slide support bar 10, a pedal driving exerciser 20 which is connected to the front-end of slidable bar 10, and an arched massager 30 which is supported above the middle part of the slidable bar 10 with its front pivotally supported in the front sliding mechanism 40, its rear pivotally supported in backward sliding mechanism 50 and its sides supported in a U-shaped support frame 31. The two sliding mechanisms 40, 50 are set on the slidable bar 10 at the front and rear respectively of arched massager 30, a two-handed use handlebar swinging exerciser 60 is set pivotably on rear sliding mechanism 50 and an elastomeric seat mat 70 covers arched massager 30.

As shown in FIGS. 3, 4 and 5, slide bar 10 is formed as a rectangular brace, having positioning holes 101, 102 at its opposed ends and and at least three position holes 103 in its middle part for securement of U-shaped support frame 31.

Figure 3:
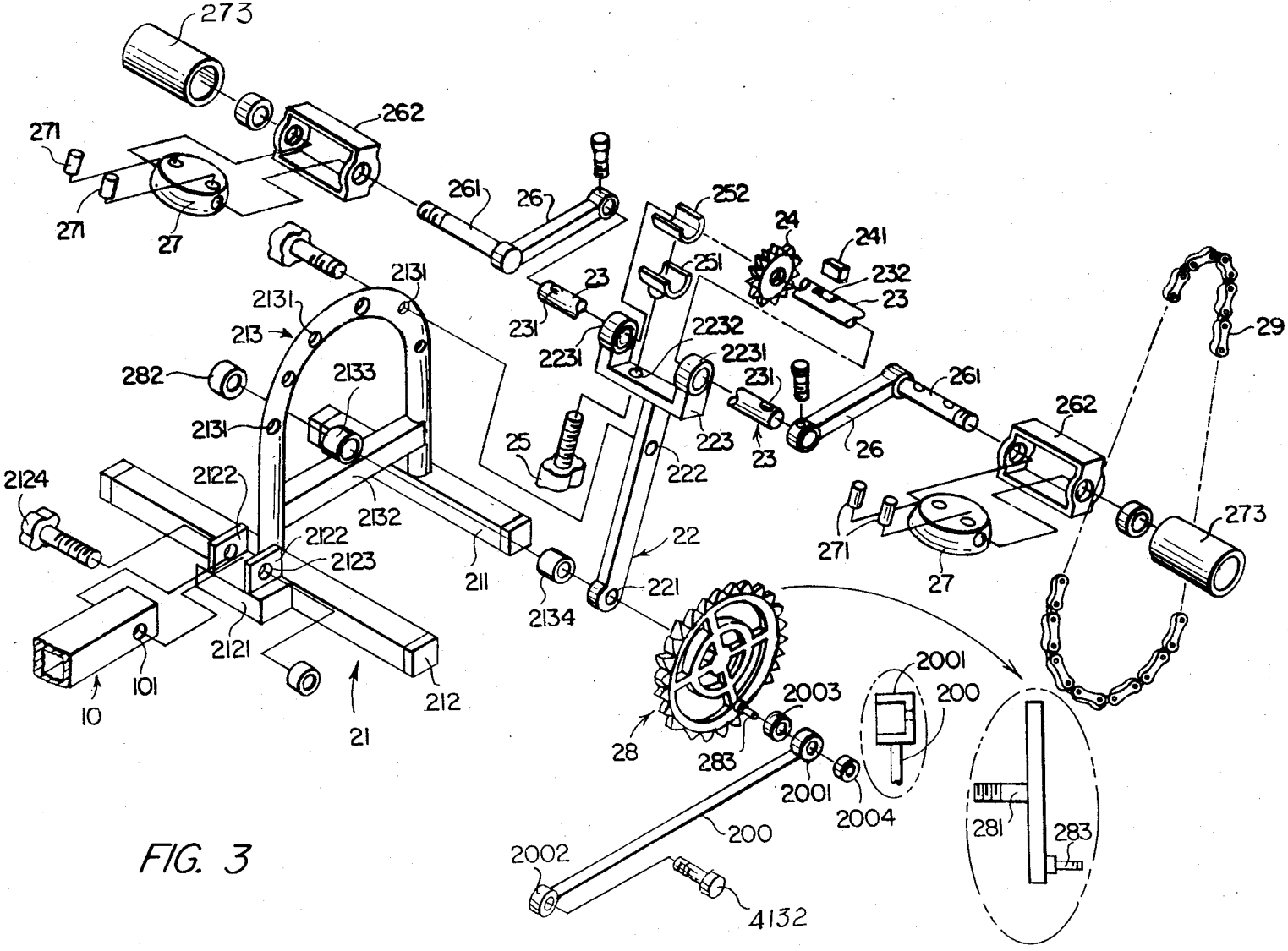
FIG. 3 is a fragmentary, exploded perspective of the pedal driving unit.

Stepped pedal driving exerciser 20 (as shown in FIG. 3) includes arch-forming stand 21 which is composed of a forward bottom support bar 211, backward bottom support bar 212 and an arch-forming support bar 213. In the middle part of backward support bar 212, there is formed a flanged joint 2121 which extends backwardly an appropriate length, and on the said flanged joint 2121 there are two upwardly extending pivotal joint pieces 2122. In these pivotal joint pieces 2122, position holes 2123 are formed. Pivotal joint pieces 2122 are joined fixedly with the front end of slidable bar 10 by means of aperture 2123 and a rotatable screw plug 2124. Arched support bar 213 includes positioning holes 2131 at its curved mid portion and a side support bar 2132 extends at a certain height between the two sides. Side support bar 2132 not only increases strength, but also supports a pivot ring 2133 at its middle part, including ball bearing 2134 which is positioned within ring 2133.

As shown in FIG. 3, position regulating bar 22 includes pivoting hole 221 at its bottom, position adjusting screw hole 222 at mid portion and a U-shaped yoke 223 at its top.

Two ball bearings 2231 are supported in the side ends of the top of the yoke 223. A regulating screw hole 2232 is defined in the yoke 223's flat surface.

Hollow axle 23, extends laterally through the two ball bearings 2231 of U-shaped yoke 223. Two positioning holes 231 are defined in the two ends of axle 23. Key way 232 is defined in a mid portion of axle 23. The upper and smaller ratchet wheel 24 is positioned by means of key way 232 and a square key 241, engaging axle 23.

Threaded regulating pivot bolt 25 extends upwardly through regulating hole 2232 defined in the flat portion of yoke 223. Semi-circular brake device 251 is thus secured in yoke 223 below hollow axle 23. Brake device 251 could include an inner brake pad 252 which covers a portion of the arched surface of hollow axle 23, so as to enable braking of the rotating force of axle 23, by screwing or braking force of pivot bolt 25.

Pedal cranks 26 attached at one end to axle 23 and at the other end to pedal axle 261, and, thus, pedals 262 are provided to enable pedaling, as in a normal bicycle.

Within each pedal 262, there is provided a cake-like plastic block 27 which surrounds pedal axle 261 and is locked tight with two lock bars 271. Besides, there is provided an elastic clothing cover 273 which covers plastic block 27. When the exerciser uses his feet to pedal pedal 262, the plastic block 27 is rotated simultaneously with pedal axle 261, thus, providing a massaging action through contact with the simultaneous rotation of plastic block 27. At the same time, elastic clothing cover 273 not only keeps adequate position by its elasticity, but also enables the exerciser's soles to obtain a cushioning while in contact with the pedal exerciser.

Big ratchet wheel 28 has an axle 281 at its middle part which can easily extend through the bottom end hole 221 of position regulating bar 32 and ball bearing 2134 of pivotal ring 2133 for locking by screw nut 282. Cam 283 extends laterally from the outer side of ratchet wheel 28, such that one end can threadably engage a bearing 2003 and pivot array 2001 of bar 200 for locking by nut 2004. Sprocket chain 29 interconnects the two ratchet wheels 28, 24. Transmission bar 200 includes, also, pivot rings 2002 at its rear end.

As shown in FIG. 3, threaded position regulating pivotal bolt 002 is provided to adjust the angle of position of regulation bar 22 with respect to arched support 213 and in conformance with the physique of the exerciser in order to provide the most comfortable pedaling action. Bolt 002 extends through position hole 2131 of the arched support bar 213 and is locked tight in the position screw hole 222 of the position regulating bar 22.

Figure 4:
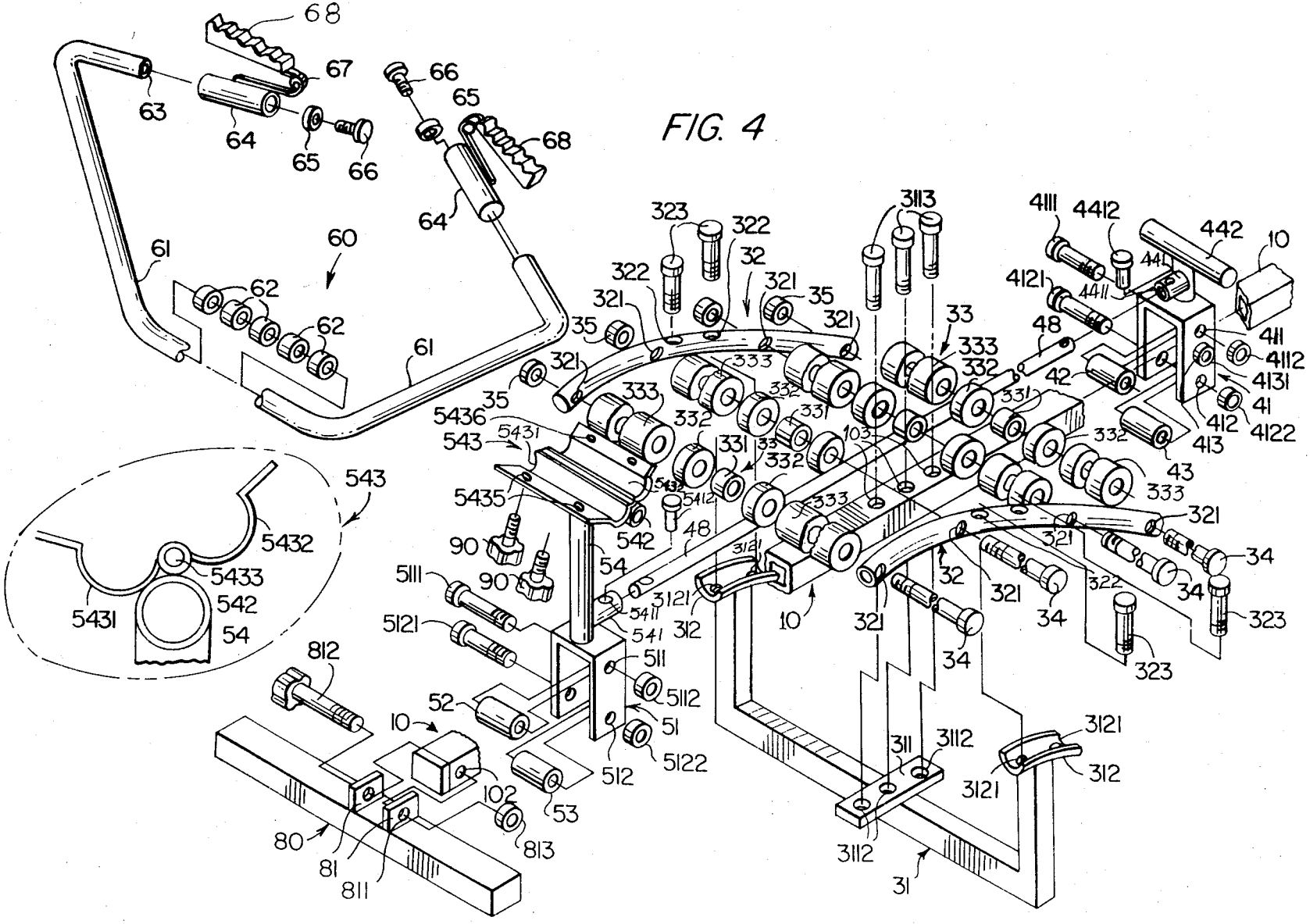
FIG. 4 is a fragmentary, exploded perspective of the handlebar exercise massager mechanism.

As shown in FIG. 4, arched massager 30 includes a U-shaped support frame 31 having support board 311 T-welded at its middle, so as to provide at least three positioning screw holes 3112. Support board 311 is fixedly secured to the middle part of the slide bar 10 by means of pivot bolts 3113 extending through the positioning holes 103 in slidable bar 10 to engage positioning screw holes 3112. There are provided two semi-circular supporters 312 at the upstanding ends of U-shaped support frame 31. Each support bar 312 has at least two positioning screw holes 3121. There are provided two arched support bars 32, having at least two horizontal positioning holes 321 defined in the curved edges of their mid portion. Also, there are provided at least two vertical positioning holes 322 such that the two support bars 32 can be locked tight on the semi-circular supporters 312 of the U-shaped supporting stand 31 by means of pivot bolts 323 threadably engaging positioning holes 3121. Thus, these two arched support bars 32 are supported in spaced relationship with side bar 10 and with the front end in a low position and the back end in a high position. Several sets of slidable rollers 33 are provided, each of them having one small-diametric stop ring 331, two rollers 332 adjacent to these stop rings 331, and two rolling tubes 333 which are adjacent to the outer sides of rollers 332. Owing to the combination of the through axles 34 and the screw nut 35, slidable rollers 33 are orderly and removably set between two arched support bars 32 and thus, when the exerciser is lying upon the massaging frame 30, he obtains a comfortable massaging effect by its smooth sliding of his body fore and aft. Especially, by virtue of the said small-diametric stop ring 331 between the said two rollers 332, the exerciser obtains concurrently a comfortable massage for the spinal cord.

The front sliding mechanism 40 includes an inverted supporter 41 which includes through holes 411, 412 at the upper and lower part of it. Pivot axles 4111, 4121 are combined with screw nuts 4112, 4122 to extend through the upper and lower rollers 42, 43 as a support, these upper and lower rollers 42, 43 can just engage smoothly the upper and lower plane surfaces of slide bar 10.

At one side of the inverted supporter 41, there is provided one axial flange 413 which includes one positioning screw hole 4131, for engagement with pivot bolt 4132 (please refer to FIGS. 3 and 4), so as to link the joint ring 2002 of the transmission bar 200 of the stepped driving exerciser 20 together with inverted supporter 41. Thus, said forward sliding mechanism 40 bears the movement of the stepped driving exerciser 20, rendering synchronous front and back displacement action upon the slidable bar 10.

Besides, and as illustrated in FIG. 4, at the upper end of the inverted supporter 41, tube 44 extends vertically to a certain height where one joint tube 441 extends rearwardly for a certain length while providing positioning hole 4411 therein. And at tube 44 top, there is provided a horizontally extending pivoting joint tube 442. The forward end of joint bar 48 is set in joint tube 441 and secured by screwing pivot bolt 4412 at the proper position.

There is also provided rear inverted supporter 51 in the rear sliding mechanism 50. Adjusting through holes 511, 512 are provided in the upper and lower part of inverted supporter 51 sides. Pivot axles 5111, 5121 in combination with screw nuts 5112, 5122 extend through the upper and lower rollers 52, 53 which are positioned in the supporter 51 thereby. Rollers 52, 53 in turn also slidably engage with slide bar 10 upper and lower surfaces. Tube 54 extends vertically above inverted supporter 51 top, so as to be at the same height as arched massager 30. At the tube 54 lower portion, axial connecting tube 541 extends horizontally forward and includes positioning through hole 5411.

Pivot bolt 5412 to extends vertically downward through hole 5411 and support link bar 48 end in order to permit the forward and backward sliding mechanisms 40, 50 to maintain a synchronous movement on slide bar 10. An upper leveling pivotal tube 542 so as to engage and support the massaging frame 30 is provided on the top of the vertical tube 54, and on the back top of tube 542 there is set support ring 543 by means of weldment on tube 542 top following edge. Also, another pivotable support ring 5432 is pivoted onto the fixed support ring curved portion 5431 by means of a link pin 5433 as a leaf-formed combination thereon.

Certain length planar bars may extend laterally out from each one end of the support rings 5431, 5432 and include regulating screw holes 5435, 5436 extending into these planes respectively.

Handlebar swinging exerciser 60 has one pentagonally formed rowing bar 61 in which there are at least two rubber rings 62 encircling the mid portion. Rings 62 are provided to rest pivotally within support ring 543 of rear sliding mechanism 50. Thus rubber rings 62 are fitted within fixed support ring 5431 and pivoted support 5432, while the two threaded regulating pivot bolts 90 extend through regulating screw holes 5435, 5436 of the fixed support ring 5431 and the pivoted support ring 5432, so that screwing action controls the desired force for rowing of the rowing bar 61. Besides, an eccentric and relatively small screw nut 63 is welded within each end of rowing bar 61. Thus, when the handlebar tubing cover 64 covers the two ends of the rowing bar 61 with the screwing of pivot bolt 66 for positioning the said handle tubing cover 64, the exerciser can maintain the tubing cover in a self-rotatable manner, but free from loosening. There is provided a compression spring 67 at each handlebar end, secured at one end on the outer part of the tubing cover 64 and its other end secured under the arched handle 68 bottom in order not only to promote more healthy exercise of the exerciser's arm muscles when he propels rowing bar 61, but also, in the combination of the arched handle 68 and the setting of the compression spring 67 in the tubing cover 64 to afford the joints of the fingers more healthy exercise.

Figure 5:
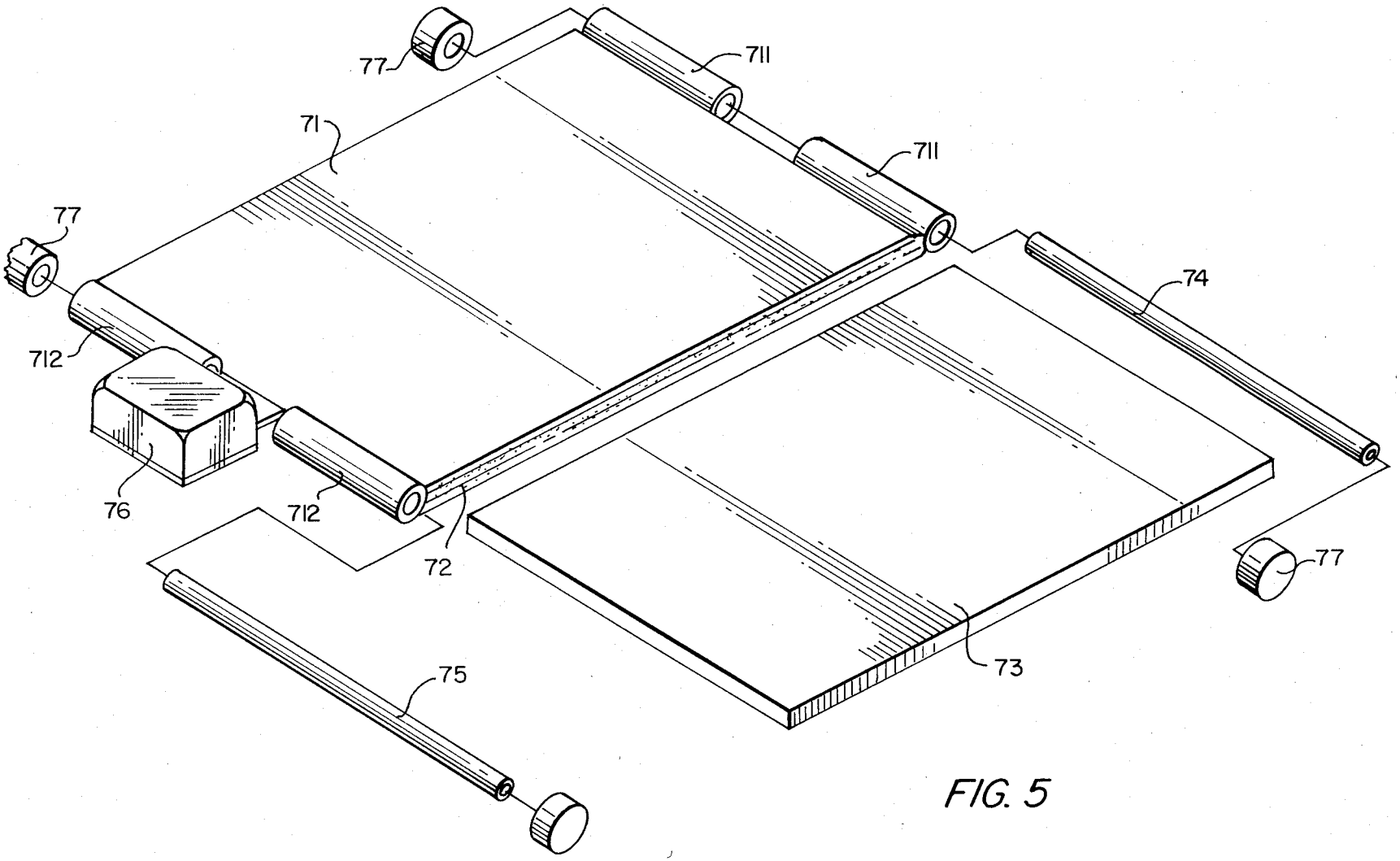
FIG. 5 is an exploded perspective of the elastomeric mat and pillow supported upon the massaging frame.

With respect to the elastomeric seat mat 70 illustrated in FIG. 5, there is provided soft clothing cover 61 which has a zipper 72 on its side which secures elastomeric mat 73 inside. Two covering tube 711, 712 are sewn on the front and back sides of the cover 71 respectively so as to accommodate through axles 74, 75 extending through leveling pivotal link front tube 442 and rear tube 542 respectively of the forward and rear sliding mechanisms 40, 50 (please refer to FIG. 4). Due to the pivot positioning of through axles 74, 75, each rubber cover 77 covers the ends of the axles in order to prevent cloth cover 71 detachment.

Between the two covering tubes 712 of the rear of cloth cover 71, there may be provided pillow 76 which serves as a support for the exerciser's head and extends from cloth cover 71 and over rear sliding mechanism 50.

With respect to rear bottom support bar 80 (please refer to FIG. 4), two pivotal link ears 81 are provided, set on the middle portion of said bar 80, each link ear 81 having through holes 811 to align with through holes 102 defined in sliding bar 10 rear. Threaded pivot bolt 812 extends through holes 102 and 81 and is secured by screw nut 813.

Figure 1:
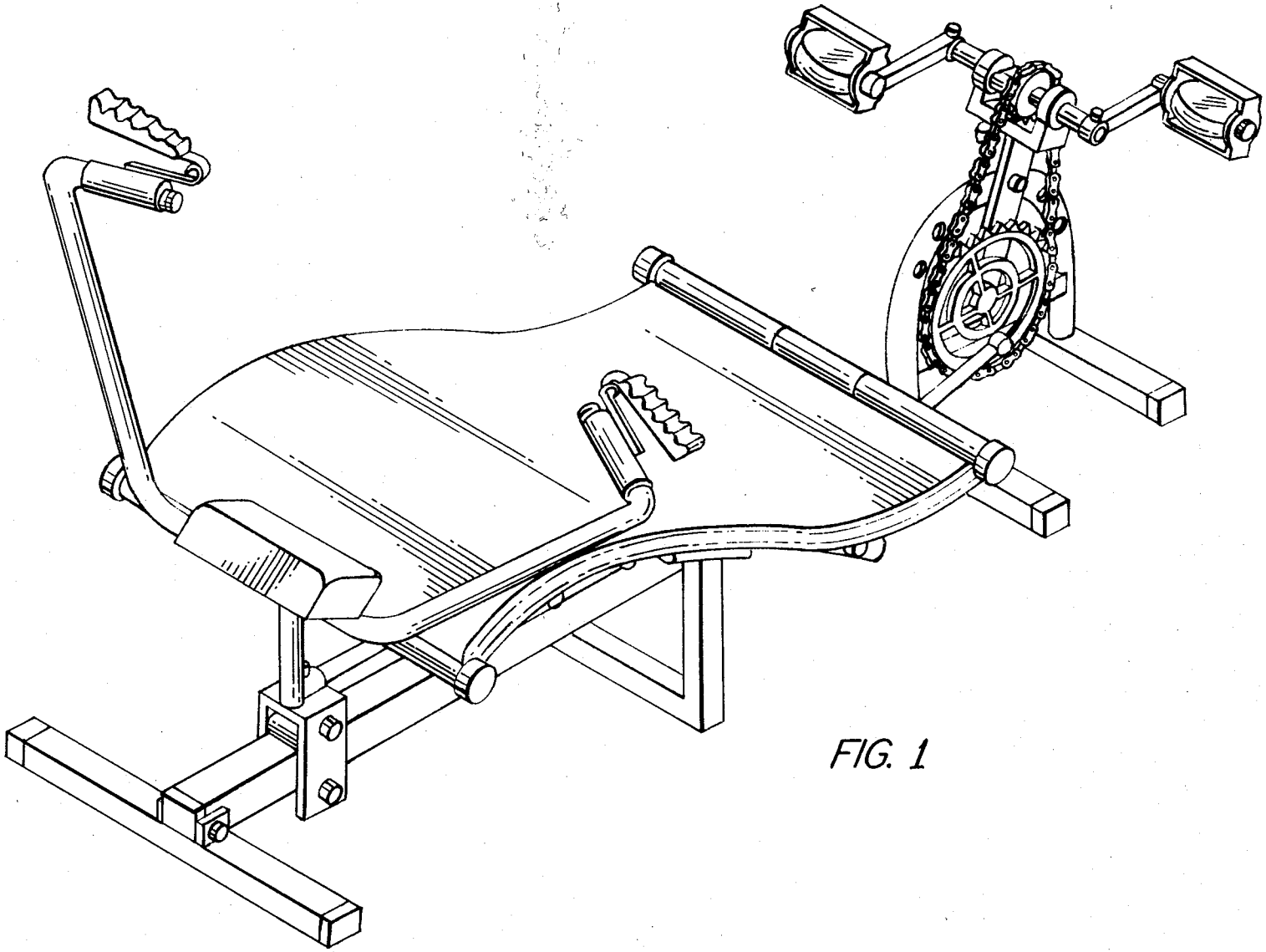
FIG. 1 is a perspective of the exercising apparatus.
Figure 2:
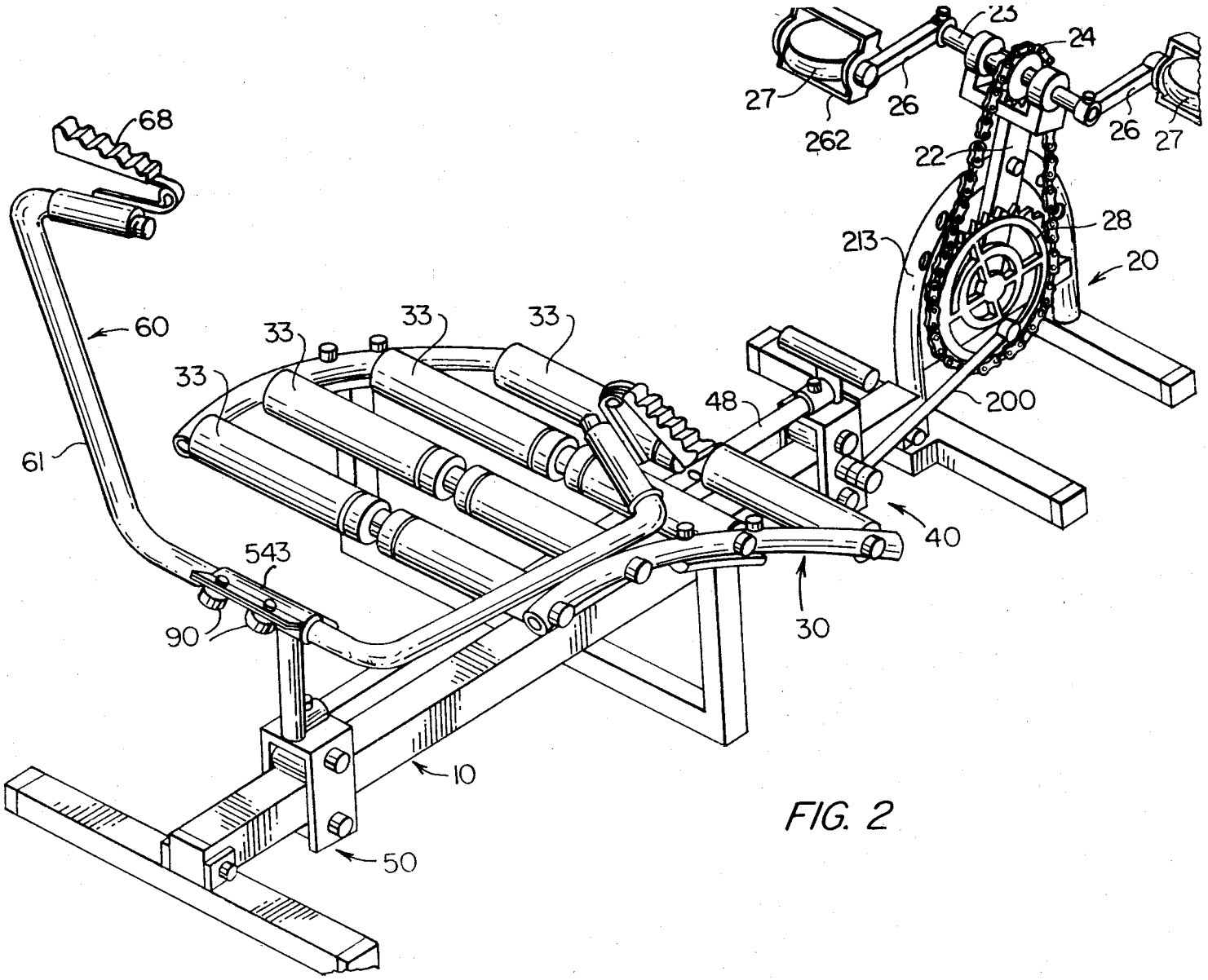
FIG. 2 is a fragmentary perspective of the inner structure.

See FIGS. 1, 2 and 3 for illustration of the connection and firm support of sliding bar 10 with U-shaped support 31 of arched massager 30, as well as the forward and rear bottom support bars 211, 212 of the stepped pedal driving exerciser 20. In complete assembly, forward sliding mechanism 40 and backward sliding mechanism 50 are connected for synchronous sliding by pivotal joinder with link bar 48. Besides, forward sliding mechanism 40 is also pivotally linked with the lower ratchet wheel 28 of the stepped pedal driving exerciser 20 by means of link bar 200. Therefore, when the exerciser is lying on seat mat 70 which covers the arched massager 30, the exerciser is moved or massaged by the forward and backward sliding mechanism 40, 50 respectively. And while the exerciser's feet are stepping upon foot pedal 262, his body will move in accordance with the front and rear displacement provided by the forward and backward sliding mechanisms 40, 50. A synchronous and harmonic massage is provided by the movement of the exerciser's body over arched massager 30 which is located in a spaced apart position and with a front-low and rear-high profile.

Furthermore, due to each small-diameter stop ring 331 which is setting loosely at the middle portion of each set of rollers 33, the exerciser's back (including his spinal cord) while being moved or displaced over massager obtains a sufficient and comfortable massaging effect.

Besides, due to the cake-like plastic block 27 (illustrated in FIG. 3) which is set firmly upon pedal axle 261 of the pedal driving exerciser 20, the exerciser not only can obtain a physical exercise for the feet by stepping on pedal 262, but also can obtain a massage action for his sole by means of the said plastic block 27 which is rotated upon pedal axle 261 and makes some discontinuous contacts with the sole thereby.

Through axle 23 of pivotal setting pedal crank 26 duly controls the exerciser's foot stepping action by means of the combined regulation of the threaded pivot bolt 25, brake device 251 and the brake shoe 252 thereon. The direction regulating bar 22 which is pivotally connected to the axle 23 adjustably sets the angle of bar 22 with respect to arched stand bar 213, so as to let the exerciser's feet have a most comfortable stretching in conformance with the physique of the exerciser.

Since rowing handlebar 61 of the hand rowing exerciser 60 is covered at its end with elastic rubber rings 62 and pivotally set within the back of support ring 543 of the forward sliding mechanism 50, support ring 543 will control effectively the exerciser's hand propelling action by means of regulating the two threaded regulating pivot bolts 90. Thus, when the exerciser is lying on the seat mat 70 which covers the arched massager 30, his hands grasp handles 28 of rowing bar 61 for doing his hand exercise in combination with his body movement. The combination of handle 68 with the rotatable hand tubing cover 64 and the compression spring 67 in provides a self-rotatable elastic device for keeping the arms free from twisting while using the hands to row. Consequently, a comfortable exercising motion for the exerciser's fingers and finger joints is also provided.

By virtue of the above-described assembly, when the exerciser is lying on the elastomeric seat mat, he can get a comfortable pedaling exerciser for his feet while he uses the pedal driving equipment and his back will move in accordance with the displacement of the arched massager and simultaneously obtain a directly comfortable massage from that massager. Besides, his hands may be rowing the rowing handlebar to combine with his body's longitudinal movement in order to obtain simultaneously an effective rowing exercise.

In summary, the present invention provides a new and multi-practicable physical training apparatus with an integrated structure, simultaneously enabling several kinds of exercise and providing comfortable physical-relieving or massaging effects when in use.

I claim:

1. A new and multipracticable physical training apparatus comprising:

(a) a longitudinally extending angular frame defined by:
(i) a laterally extending rear support bar;
(ii) a longitudinally extending slide bar connected at its rear end to said rear support bar;
(iii) a laterally extending backward support bar, adapted for pedaling exerciser and connected to the other end of said longitudinally extending slide bar;

(b) a stepped pedaling exerciser further including:
(i) an arched support bar having its backward end seated in said backward support bar and its forward end seated in a forward support bar, said arch support including a plurality of position regulating holes defined in its curved edge and extending between the forward and backward bottom support bars with a side support bar extending between the two ends of the arch support;
(ii) a directional regulating bar pivoted at its lower end in said side support bar and having an adjusting aperture alignable with said regulating position holes in said arch support at its mid portion, said regulating bar including a yoke defining left and right hand apertures for a hollow axle at its top;
(iii) a small ratchet wheel mounted on a hollow axle within said yoke;
(iv) a foot pedal attached to pedal axle extending laterally on each side of said arch support and pivotally engaging pedal cranks, in turn, pivotally supported on each end of said hollow axle;
(v) a big ratchet wheel rotatably positioned by means of a drive axle extending through the regulating bar bottom hole and a pivotal connector defined in the side support bar, chain means interconnecting the small ratchet wheel and the big ratchet wheel; and
(vi) a link bar pivotally connected at its forward end to said big ratchet wheel with its rear end extending towards the forward end of said frame;

(c) an arched massager apparatus further including:
(i) a U-shaped support frame positioned intermediate said rear support bar and said backward support bar and extending below said longitudinally extending side bar to which it is affixed and above both sides of said longitudinal support bar, said arched support bar further including:
(i) an arch support bar supported upon each upstanding end of said U-shaped support frame so as to support a massaging frame with a front low and rear high profile above said longitudinally extending support; and
(ii) a plurality of sets of rolling devices mounted upon axles extending laterally throughout said frame, such that rolling devices engage the back of an exerciser supported thereon;

(d) a forward sliding mechanism of inverted U-shaped configuration having an upper roller and a lower roller respectively engaging the top and bottom of said longitudinally extending slide bar, said forward sliding mechanism slidably positioned at the front end of said slide bar so as to be engagable pivotally with the rear end of said link bar of said stepped pedaling exerciser and including a vertically extending upper tube and a longitudinally extending flange tube;

(e) a backward sliding mechanism of inverted U-shaped configuration having an upper roller and a lower roller respectively engaging the top and bottom of the rear of said longitudinally extending slide bar, including a vertically extending draw tube and one longitudinally extending flange tube, said draw tube supporting at its top an adjustable horizontally extending pivot link tube and supporting a rear portion of said massaging frame;

(f) a joint bar extending from the flange tube of the rear sliding mechanism to the flange tube of the forward sliding mechanism to maintain synchronous, sliding movement between said forward and backward sliding mechanism;

(g) a hand rowing exerciser in the form of a rowing handle bar positioned in said horizontally extending pivot link tube and extending outwardly of said device, said handle bar having a plurality of elastic rubber rings on its mid portion and supported within said pivot link tube;

(h) an arched handle positioned at each handlebar end and further including:
(i) a compression spring, and
(ii) a hand gripping tube rotatably supported at the outer ends of said handle bar, such that said hand gripping tube pivots upon said handle bar;

(i) an elastomeric seat mat having a soft clothing cover supported upon said massaging frame and including:
(i) covering tubes which engage the forward and rear portions of the frame; and
(ii) a pillow connected to the back of said mat and extending between the covering tubes mounted upon the rear portion of the frame.

2. A new and multipracticable physical training apparatus as in claim 1, further including:
(a) a cake-like plastic box supported upon each pedal axle such that discontinuous contact between the pedal axle and the plastic box massages the sole of the exerciser's foot.

3. A new and multipracticable physical training apparatus as in claim 2 further including an elastic clothing cover for said cake-like plastic box, so as to cushion the exerciser's sole.

4. A new and multipracticable physical training apparatus as in claim 1 said directional regulting bar including a braking device supported in said U-shaped yoke and engaging said hollow axle.

5. A new and multipracticable physical training apparatus as in claim 1, said backward sliding mechanism horizontally extending support tube for said handle bar being of an adjustable leaf construction, so as to enable frictional control of the rowing action of said handle bar.

6. A new and multipracticable physical training apparatus as in claim 1, including eccentric screw nut means mounted within each handle bar end, so as to permit said tubing cover to be supported thereon in a freely rotatable attitude.

* * * * *